US007097474B1

(12) United States Patent
Naylor

(10) Patent No.: US 7,097,474 B1
(45) Date of Patent: Aug. 29, 2006

(54) SAFETY OUTLET COVER

(76) Inventor: Robert M. Naylor, 4505 W. 5460 South, Kearns, UT (US) 84118

( * ) Notice: Subject to any disclaimer, the term of this patent is extended or adjusted under 35 U.S.C. 154(b) by 0 days.

(21) Appl. No.: 11/234,783

(22) Filed: Sep. 23, 2005

(51) Int. Cl.
*H01R 13/44* (2006.01)

(52) U.S. Cl. ..... 439/135; 439/136; 439/373; 439/142; 174/67; D13/156

(58) Field of Classification Search ..... 439/134–136, 439/142, 373; 174/67; D13/156
See application file for complete search history.

(56) References Cited

U.S. PATENT DOCUMENTS

| | | | | |
|---|---|---|---|---|
| 2,761,112 | A * | 8/1956 | Torcivia | 439/147 |
| 3,467,763 | A | 9/1969 | Shaw | |
| 3,729,572 | A * | 4/1973 | Helin | 174/66 |
| 5,218,169 | A | 6/1993 | Riceman | |
| D354,736 | S * | 1/1995 | Hallett et al. | D13/156 |
| 5,556,289 | A | 9/1996 | Holbrook, Jr. | |
| D381,631 | S * | 7/1997 | Hallett et al. | D13/156 |
| 6,198,046 | B1 | 3/2001 | Moodie | |
| 6,309,239 | B1 * | 10/2001 | Johnston | 439/373 |
| D460,421 | S * | 7/2002 | Marozsan, Jr. | D13/156 |
| 6,457,843 | B1 * | 10/2002 | Kester et al. | 362/276 |
| 6,699,060 | B1 * | 3/2004 | Scott | 439/373 |
| 6,805,580 | B1 | 10/2004 | Piedmont | |

* cited by examiner

*Primary Examiner*—Tho D. Ta
(74) *Attorney, Agent, or Firm*—Starkweather & Associates; Michael W. Starkweather; Jason P. Webb

(57) ABSTRACT

A safety outlet cover, comprising a base plate placed adjacent to an outlet, a first shell in contact with the base plate, and including a first cord aperture, a second shell in contact with the base plate, and including a second cord aperture that coordinates with the first cord aperture, and an attachment device passing through the base plate, first shell and second shell attaching the safety outlet cover to an outlet. The safety outlet cover may also include a fastening device securing the first and second shells in a closed position. The attachment device may comprise a screw. The safety outlet may comprise a cover plug covering the cord aperture.

5 Claims, 3 Drawing Sheets

SAFETY OUTLET COVER

BACKGROUND OF THE INVENTION

1. Field of the Invention

The present invention relates to safety outlet covers, specifically safety outlet covers for electrical outlets.

2. Description of the Related Art

In U.S. Pat. No. 6,805,580, a safety cover installed over an electrical wall outlet is disclosed, which comprises two quarter-shell segments hinged about their median sections to a base. When the two segments are clamped together, they form a protective hood over the outlet. When separated, the segments fall away from the outlet to provide free access to it. A sleeve surrounding the base can be slid over the root of the shell segments to lock them in their closed position. The mating edges of the clamped segments are indented in their center section to accommodate the electrical cord of a jack plugged into the outlet.

U.S. Pat. No. 6,198,046 discloses a device that includes a base plate attachable to an electric outlet and an insert fitted to the base plate and having one or more central openings for exposing the receptacles of the electric outlet. A pair of opposing door members attach to the base plate and are operable between an open position to allow insertion of a plug of an electrical cord into the receptacle, and a closed position to provide a protective shield surrounding an enclosed chamber and the one or more receptacles of the outlet. The opposing door members include flange portions extending partially along a peripheral edge for overlapping engagement with an inner surface adjacent the peripheral edge of the opposite door, preventing insertion of an object between the doors when the device is closed. Correspondingly positioned cutout portions along the peripheral edges of the opposing door members align to create an opening sized and configured to accommodate passage of the electrical cord there through, thereby permitting the cord to remain plugged into the receptacle with the doors in the closed position. Latches on the top and bottom of each door lock the doors in the closed position. The latches and flange portions function, in combination, to provide a child resistant safety feature, requiring both doors to be simultaneously unlocked and opened in order to gain access to the receptacles.

U.S. Pat. No. 5,556,289 discloses a safety cover for an electrical outlet including a hollow rigid container having a back wall with a periphery extended outwards therefrom and thereby defining a hollow interior, an opening to the interior, and a rim bounding the opening, the back wall further including a plurality of socket holes and a screw hole formed thereon and with the socket holes and screw hole alignable with a screw hole and corresponding socket plugs of an electrical receptacle; a rigid lid positionable over the opening of the container in contact with the rim, the lid further having a plurality of plug holes formed thereon and with each plug hole separately alignable with a socket hole of the back wall of the container; and a plurality of rigid doors with each door positionable within a plug hole of the lid and thereby creating a through hole for receipt of an electrical cord; and a coupling mechanism for removably coupling each door within a separate plug hole of the lid.

U.S. Pat. No. 5,218,169 discloses a safety cover for an electric receptacle having a mounting plate fitting over an electrical receptacle, and a cover assembly with a cover edge extending around the periphery thereof, the mounting plate having an edge engagable surface thereon corresponding in shape to the cover edge. The cover assembly is mountable on the mounting plate between a closed and an open position. The cover assembly has a plurality of locking projections spaced around the periphery of the cover assembly at positions so that they are incapable of simultaneous operation by a hand below a predetermined size. When the cover assembly is closed, locking hooks on the locking projections engage in locking hook-receiving apertures in the mounting plate structure and the cover edge is snugly abutted against the edge engagable surface. The cover assembly can be moved to the open position only by simultaneous deformation of the cover assembly at the positions of the locking hooks sufficient to move the locking hooks sufficiently far inwardly of the cover assembly to free the locking hooks from the locking hook receiving apertures.

U.S. Pat. No. 3,467,793 discloses a safety cover for electrical outlets which can be mounted on the electrical outlet without changing the same and in which locking means has been provided to prevent the same from being opened by children.

Finally, U.S. patent D460,421 discloses the ornamental design for a hinged outlet cover.

What is needed is a safety outlet cover that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available safety outlet covers. Accordingly, the present invention has been developed to provide a safety outlet cover, comprising a base plate placed adjacent to an outlet, a first shell in contact with the base plate, and including a first cord aperture, a second shell in contact with the base plate, and including a second cord aperture that coordinates with the first cord aperture, and an attachment device passing through the base plate, first shell and second shell attaching the safety outlet cover to an outlet.

The safety outlet cover may comprise a fastening device securing the first and second shells in a closed position. The attachment device may comprise a screw. The safety outlet may comprise a cover plug covering the cord aperture.

In another embodiment, the safety outlet cover consists only of a base plate placed adjacent to an outlet, a first shell in contact with the base plate, and including a first cord aperture, a second shell in contact with the base plate, and including a second cord aperture that coordinates with the first cord aperture, and an attachment device passing through the base plate, first shell and second shell attaching the safety outlet cover to an outlet.

The first shell and second shell may further include a fastening device securing the first and second shells in a closed position. The attachment device may comprise a screw. The attachment device may extend through the first and second shells. The safety outlet cover may comprise a cover plug covering the cord aperture.

The first shell and second shell may further comprise a fastening device securing the first and second shells in a closed position. The attachment device may comprise a screw. The safety cover device may include a cover plug to cover the cord aperture.

In yet another embodiment, the safety cover comprises a base plate placed adjacent to an outlet, a first shell in contact with the base plate, and including a first cord aperture, a second shell in contact with the base plate, and including a second cord aperture that coordinates with the first cord aperture, a screw-type attachment device passing through the base plate, first shell and second shell attaching the safety outlet cover to an outlet, a fastening device securing the first and second shells in a closed position and a cover plug covering a cord aperture.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
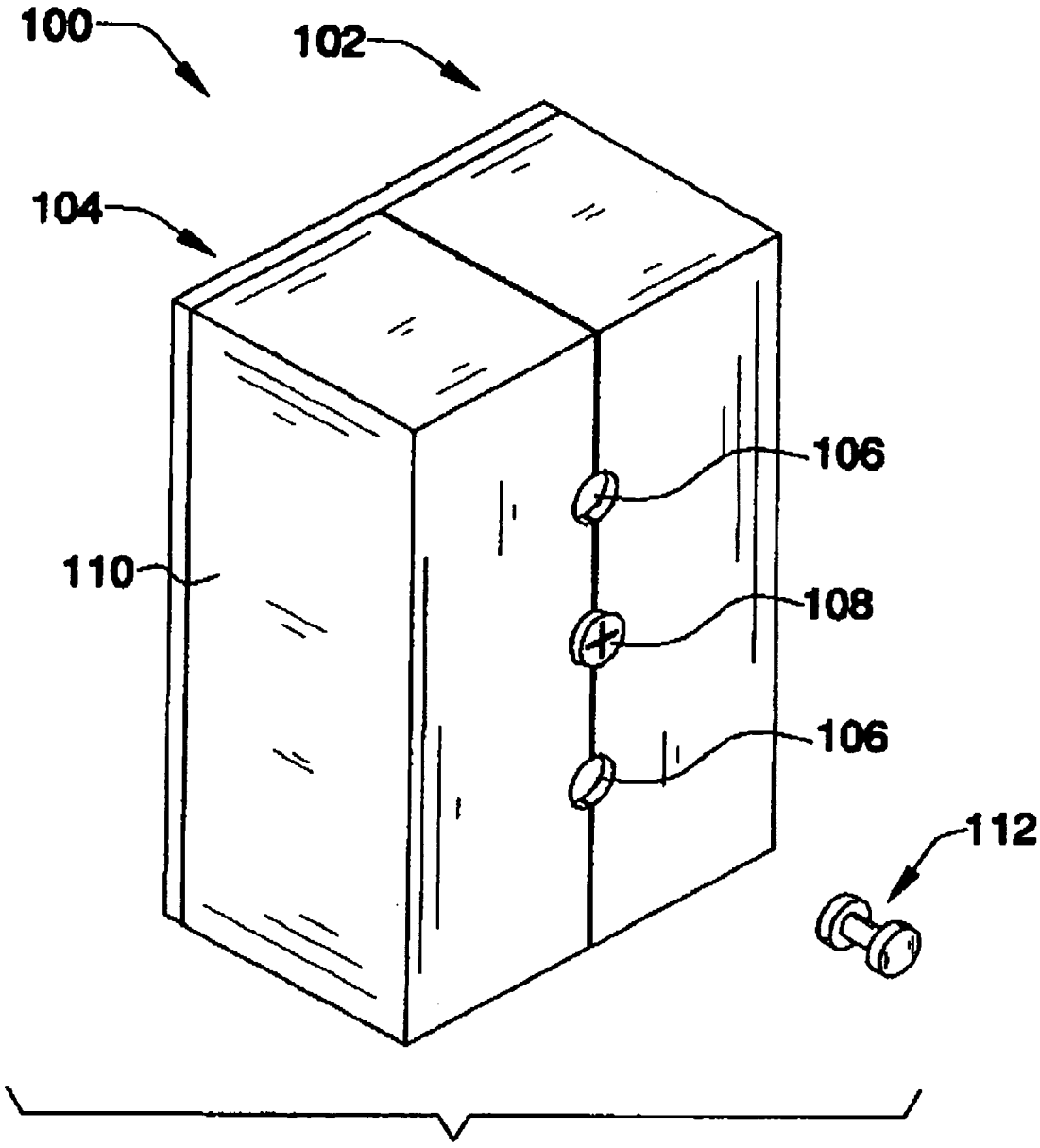
FIG. 1 illustrates a perspective view of a safety outlet cover according to one embodiment of this invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

FIG. 1 illustrates a perspective view of a safety outlet cover 100 according to one embodiment of this invention. The safety cover includes a base plate 110 to which a first shell 104 and a second shell 102 are in contact. According to this invention, the base plate 110 may be any base plate known in the art. The base plate 110 need not be attached to the first shell 104 or second shell 102. The base plate 110 may consist of one or more pieces. In one example, the base plate 110 includes a wall behind an outlet. In another embodiment, the base plate 110 includes an outlet cover plate. In yet another embodiment, the base plate includes both a wall behind an outlet and an outlet cover plate.

In one embodiment, the first shell 114 and second shell 112 are held in contact with the base plate be means of a attachment device 108. The attachment device 108 may be a screw that passes through either the first shell 114, the second shell 112, or both the first shell 114 and second shell 112. In another embodiment, the first shell 104 and second shell 102 are attached using hinges that allow the first shell 104 and second shell 102 to swing open. The first shell 104 and second shell 102 are designed to completely cover an outlet and a plug when the shells 102, 104 are in the closed position, except that they allow a power cord to pass through the shells 102, 104. In one specific embodiment, the shells 102, 104 are rectangular in shape, and include face that is substantially parallel with the outlet, and top, side and bottom faces that are orthogonal to the outlet. In another embodiment, the shells 102, 104 include curved faces.

FIG. 1 also shows a cover plug 112. The cover plug may be of such a size so as to plug a cord aperture 106 when the cord aperture 106 is not being used. This may be helpful to stop moisture from entering the safety outlet cover 100. The cover plug 112 may be made of any material suitable to plug the cord aperture 106.

The safety outlet cover 100 of this embodiment includes at least one cord aperture 106 and an attachment device 108. The cord aperture 106 is configured to allow a power cord to pass through the first shell 104 and/or second shell 102. The attachment device 108 is configured to attach the safety outlet cover 100 to a structure that includes a power outlet. The attachment device 108 may be any known in the art. In one embodiment, the attachment device is a screw. In one embodiment the attachment device 108 is longer than the typical outlet screw, and has a larger head than the typical outlet screw. According to this embodiment, the attachment device 108 passes through outer surfaces of the first shell 104 and second shell 102, and the head of the attachment device 108 is large enough such that when it is tightened, neither the first shell 104 nor the second shell 102 may be opened. This embodiment has the special benefit of making it more difficult for a child to open the safety outlet cover 100.

Figure 2:
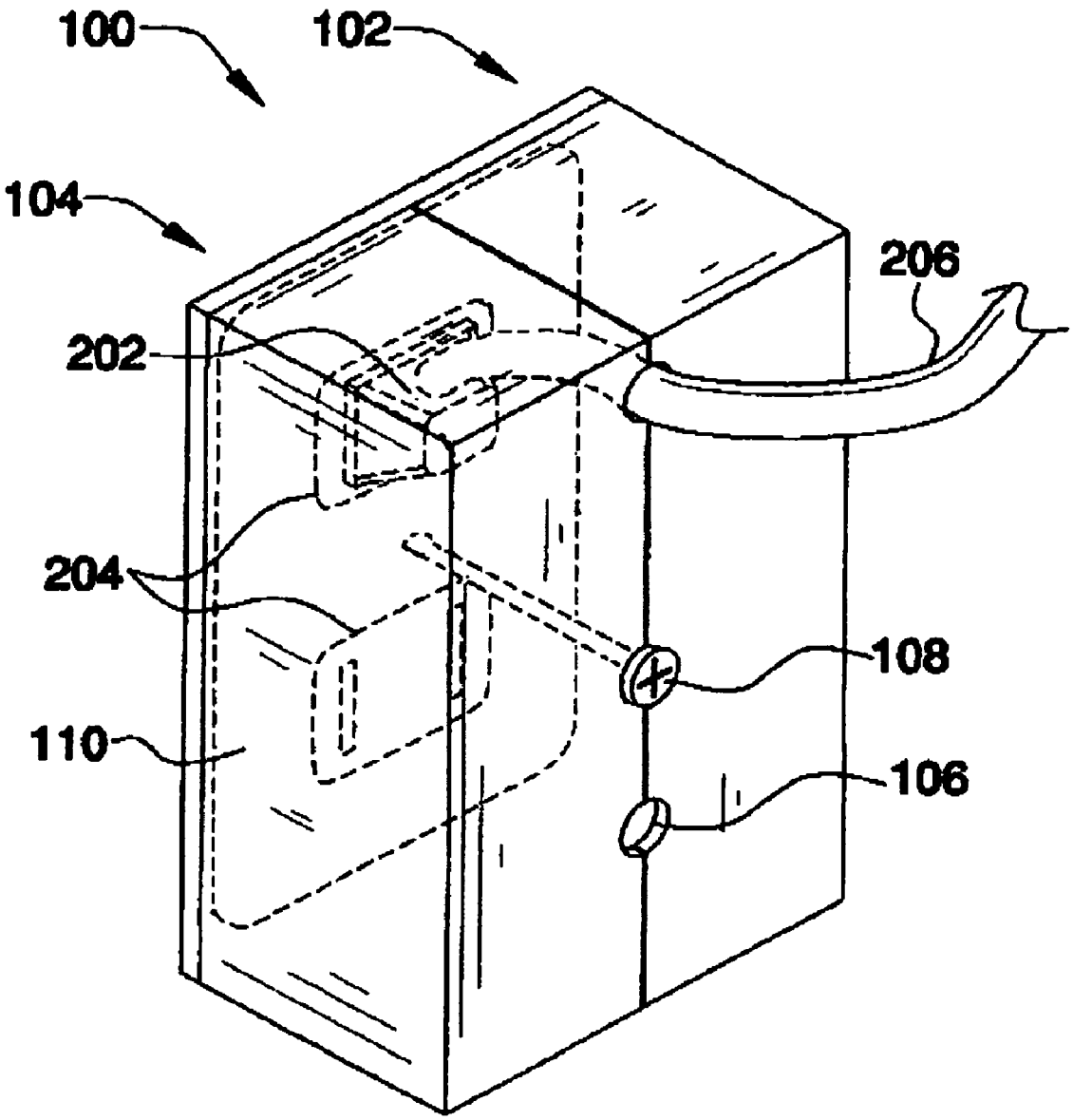
FIG. 2 illustrates a perspective view of a safety outlet cover in use according to one embodiment of this invention.

FIG. 2 illustrates a perspective view of a safety outlet cover 100 in use according to one embodiment of this invention. A plug 202 is shown in communication with an outlet 204. A cord 206 extends from the plug 202, and through the cord aperture 106 of the safety outlet cover 100. The cord aperture 106 is designed to allow the cord 206 to pass through the first shell 104 and/or second shell 102. In one embodiment, the cord aperture 106 is aligned directly behind an outlet 204. In another embodiment, the cord aperture 106 is aligned not directly behind an outlet 204 to allow for easier passage of the cord 206 through the cord aperture 106. This embodiment is especially useful as used when the cord 206 does not extend directly behind the plug 202 as illustrated in FIGS. 2 and 3.

Figure 3:
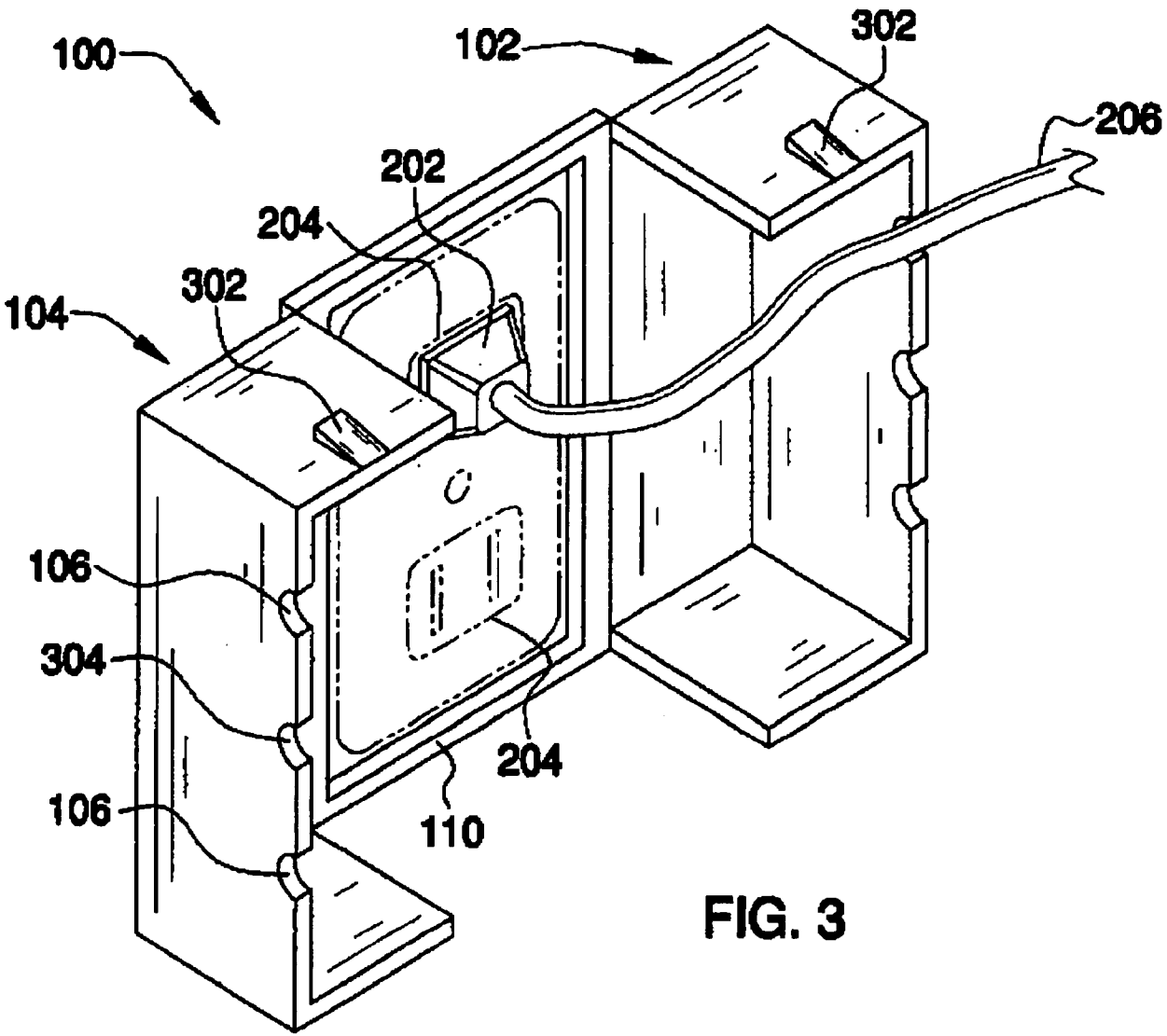
FIG. 3 illustrates a perspective view of a safety outlet cover when open according to one embodiment of this invention.

FIG. 3 illustrates a perspective view of a safety outlet cover 100 when open according to one embodiment of this invention. In this embodiment, an attachment device aperture 304 is illustrated. The attachment device 108 may pass through this attachment device aperture 304 to attach the safety outlet cover 100 to a substrate that supports an outlet 204.

In one embodiment, there is a fastening device 302 located on either the first shell 104, the second shell 102 or both shells 102, 104. The fastening device 302 may be used to fasten the first shell 104 to the second shell 102, or either or both of the first shell 104 and/or second shell 102 to another surface such that the first shell 104 and the second shell 102 cannot be easily opened to reveal the outlet 204. The fastening device 302 may be any known in the art. In one embodiment, the fastening device cannot be easily opened by children.

The safety outlet cover 100 is useful in inhibiting children from having access to outlets and plugs. This may help with the safety of children in not being shocked from playing with the covers. This may help with the prevention of power failures to certain devices than need constant power such as computers, water softeners, and so forth. The safety outlet cover 100 of this invention is also helpful with electric-powered lawn tools such as weed trimmers, electric mowers, and so forth.

In one example, the safety outlet cover 100 includes a first shell 104 and a second shell 102 that are held together by a fastening device 302. The first shell 104 and second shell 102 are held in connection with the base plate by means of an attachment device 108. The attachment device 108 may be a screw that fits in a typical screw hole of an electrical outlet. In another example, the safety outlet cover 100 of this example also includes at least one cord aperture 106. In yet another example, the safety outlet cover 100 also includes at least one cord aperture plug 202.

It is understood that the above-described preferred embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

Finally, it is envisioned that the components of the device may be constructed of a variety of materials such as, for example: metal; metal alloys; wood; plastic; polymers; composites such as fiberglass, carbon fiber, and so forth; marble; and so forth.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A safety outlet cover, comprising:

a base plate placed adjacent to an outlet;

a first shell in contact with the base plate, and including a first cord aperture;

a second shell in contact with the base plate, and including a second cord aperture that coordinates with the first cord aperture; and an attachment device passing through the base plate, first shell and second shell attaching the safety outlet cover to an outlet by pressure between the attachment device and the first shell and second shell, wherein neither the first nor the second shell connects to the base plate by a hinge, and wherein neither the first nor the second shell includes a tubular section through which the attachment device passes.

2. The safety outlet cover of claim 1, wherein the first shell and second shell further comprise a fastening device securing the first and second shells in a closed position.

3. The safety outlet cover of claim 1, wherein the attachment device comprises a screw.

4. The safety outlet cover of claim 1, further comprising a cover plug covering the cord aperture.

5. A safety outlet cover, consisting essentially of:

a base plate placed adjacent to an outlet;

a first shell in contact with the base plate, and including a first cord aperture;

a second shell in contact with the base plate, and including a second cord aperture that coordinates with the first cord aperture;

wherein the first cord aperture and second cord apertures are not located directly behind the outlet;

a screw-type attachment device passing through the base plate, first shell and second shell attaching the safety outlet cover to an outlet by pressure between the attachment device and the first shell and second shell, wherein neither the first nor the second shell connects to the base plate by a hinge, and wherein neither the first nor the second shell includes a tubular section through which the attachment device passes; and a cover plug covering a cord aperture.

* * * * *